United States Patent [19]

Gerhard

[11] Patent Number: 4,591,064

[45] Date of Patent: May 27, 1986

[54] FREIGHT CONTAINER

[75] Inventor: Helmut Gerhard, Weitefeld, Fed. Rep. of Germany

[73] Assignee: Westerwaelder Eisenwerk Gerhard GmbH, Weitefeld, Fed. Rep. of Germany

[21] Appl. No.: 678,807

[22] Filed: Dec. 6, 1984

[30] Foreign Application Priority Data

Dec. 6, 1983 [DE] Fed. Rep. of Germany ... 8334968[U]
Sep. 5, 1984 [DE] Fed. Rep. of Germany ... 8426236[U]

[51] Int. Cl.[4] ..... B65D 88/12

[52] U.S. Cl. ..... 220/1.5; 220/18.1; 220/70.1; 410/44

[58] Field of Search ..... 220/1.5, 401, 71, 18.1, 220/70.1, 72.1; 105/247, 248, 360, 362, 261 R; 222/185, 166; 410/44, 45, 47, 48, 49

[56] References Cited

U.S. PATENT DOCUMENTS

| | | | |
|---|---|---|---|
| 2,144,637 | 1/1939 | Push | 105/261 R |
| 2,160,477 | 5/1939 | Kramer | 105/360 X |
| 3,212,824 | 10/1965 | Emery et al. | 105/360 |
| 3,379,478 | 4/1968 | Aller et al. | 105/247 X |
| 3,469,742 | 9/1969 | Miller et al. | 222/185 X |
| 3,539,029 | 11/1970 | Bopp et al. | 222/166 X |
| 3,557,708 | 1/1971 | Bolte | 105/362 X |
| 4,041,879 | 8/1977 | Cockrell | 410/48 X |

FOREIGN PATENT DOCUMENTS

| | | | |
|---|---|---|---|
| 3212696 | 10/1983 | Fed. Rep. of Germany | 220/1.5 |

*Primary Examiner*—Allan N. Shoap
*Attorney, Agent, or Firm*—Barnes & Thornburg

[57] ABSTRACT

A freight container includes a tank 10 mounted in an inclined manner between a pair of end frames 12 by means of connecting structures 11 each of which contains an end ring 20 and further connecting elements 21; 30. The end rings 20 are eccentrically secured to spherically curved end bottom portions 25 of the tank 10 in such a manner that at one tank end the respective ring is offset upwardly and at the other end offset downwardly. The further connecting elements 21; 30 connect the end ring 20 to the respective end frame 12. Due to the combination of the spherically curved bottom end portions 25 of the tank 10 with the circular end rings 20, the freight container may be readily assembled with any desired tank inclination.

15 Claims, 8 Drawing Figures

FREIGHT CONTAINER

DESCRIPTION

The invention relates to a freight container of the type comprising a supporting structure and a cylindrical tank secured thereto with an inclination in the longitudinal direction.

Such an inclined position of the tank is prescribed by regulations existing in some countries for the transport of beer and other carbonated beverages. The tank must be inclined at a ratio of at least 1:20 relative to the supporting structure, which may be a frame or an undercarriage, and it must be configured in such a way that it may be completely filled and drained in this position. The tank dome has to be provided in the highest position, and a drain with a shut-off means has to be provided in the lowest position of the tank.

With a known freight container of the above-mentioned kind the tank is mounted on a supporting structure by means of a plurality of cradle members distributed in longitudinal direction, the height of these cradle members progressively decreasing towards the drain. Consequently, this structure requires that all of the cradle members should have different shapes, and the configuration and arrangement of the cradle members must be sufficiently precise so that the tank load is uniformly distributed and no peak stresses occur. Therefore the known structure is expensive in respect of both manufacture and assembly.

The invention is based on the general object of eliminating at least in part the drawbacks existing with comparable freight containers according to the prior art. It is a more special object of the invention to provide a freight container of the above-mentioned type whose manufacture and assembly requires no additional expenditure as compared to a freight container with a horizontal tank and which permits mounting of the tank at any desired inclination (within given limits) without the occurrence of any peak stresses.

In view of this object, a freight container according to the present invention comprises a supporting structure having a pair of mutually spaced end frames and defining a first longitudinal axis, a tank disposed between the pair of end frames and having a cylindrical shell portion defining a second longitudinal axis and spherically curved end bottom portions, and a pair of connecting structures joining the tank to the pair of end frames, each connecting structure including a circular end ring eccentrically fixed to the respective end bottom portion to mount the tank with an inclination between the first and second longitudinal axes.

Due to the invention, it is possible to employ the same structural elements, especially the same end rings, irrespective of the exact size of the tank and the desired inclination. The circular end rings may always be secured over their entire circumference to the spherically curved tank bottoms, so that mounting of the tank at both tank ends without any peak stresses will be possible.

In a preferred embodiment of the invention, the container tank includes a first cylindrical shell portion defining the second longitudinal axis and a second cylindrical shell portion defining a third longitudinal axis, the first and second shell portions being interconnected to form an integral tank shell with the second and third axes intersecting each other at an angle, and wherein the tank is joined to the pair of end frames so that the second and third axes intersect at a point located below the first axis. In this embodiment, the overall height of the freight container may be reduced at identical length, inclination and tank volume, as compared with a straight, inclined tank.

Furthermore, assembly of the tank between the two end frames may be facilitated by the provision of a cradle ring between each end ring and the respective end frame. In this case any tolerances in length may be compensated during assembly by axially displacing the end ring relative to the axially extending part of the cradle ring.

In another advantageous embodiment, each end frame of the container supporting structure includes vertical corner posts, horizontal cross-pieces, and diagonal struts each extending between a corner post and a cross-piece, wherein the end ring has an L-shaped cross-section with an axially extending flange welded to the respective end bottom portion and a radially extending flange, and wherein an additional diagonal element is secured to each diagonal strut, each diagonal element having at least one first surface extending in parallel to an axially extending surface of the associated diagonal strut and a second surface extending in parallel to the radially extending flange of the end ring and being coupled thereto. In this embodiment the additional diagonal elements may be simply formed of parts of commercially available sectional beams. Since there remains but a single ring, there will be no problems of fit like as may occur between the two rings. By using only a single ring it is further possible to minimize any undesirable heat build-up between tank and end frame. Moreover, the additional diagonal elements at the same time have the effect of reinforcing the diagonal struts and thus result in a stiffening of the end frame. The desired balancing of tolerances of length between the tank and the end frame is achieved by the feature that the additional diagonal elements are axially movable relative to the diagonal braces until the final, dimensionally accurate coupling has been made.

Preferred embodiments of the invention will be explained below with reference to the drawings,in which.

Figure 1:
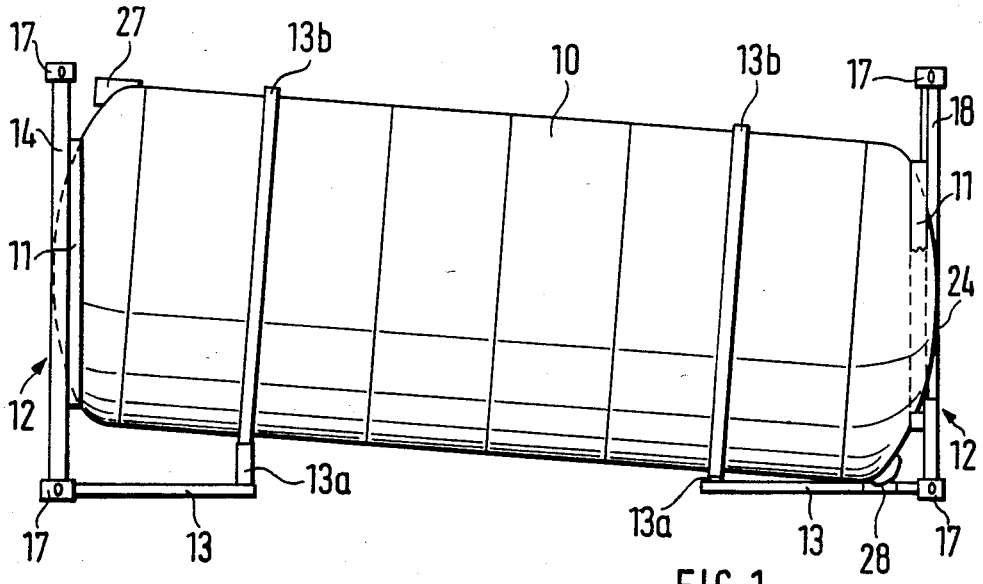
FIG. 1 is a side view of a freight container with inclined tank.

The freight container illustrated in FIG. 1 comprises a circular-cylindrical tank 10 having its ends joined to end frames 12 via connecting structures generally referenced 11. Diagonal braces 13 are secured to the two lower corners of each end frame 12, said diagonal braces extending inwardly towards one another and being either interconnected or designed as one-piece bracket, and being further joined via matching transition elements 13*a* to a reinforcing ring 13*b* surrounding the tank 10.

As shown in FIG. 1, each end frame is formed of two vertical corner posts 14, an upper horizontal cross-piece 15 and a lower horizontal cross-piece 16. Each of the four corners of each end frame 12 is provided with a standard container fitting 17. The dimensions defined by the eight corner fittings of the container correspond to international standards. Diagonal struts 18 extend from the centres of the two corner posts 14 of each end frame 12, said diagonal struts terminating at the lower cross-piece 16 (and symmetrically thereto at the upper cross-piece 15) at locations 19 which are acceptable as further bearing locations in accordance with international standards. Radially outwardly facing flange faces of the connecting structures 11 are welded to the diagonal struts 18.

Figure 3:
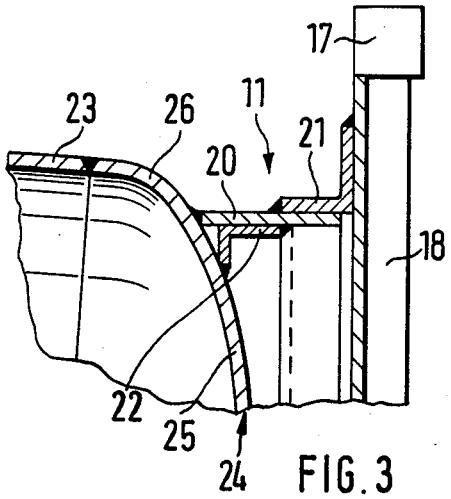
FIG. 3 is an enlarged view of the upper right-hand corner of the container shown in FIG. 1.

As will be apparent from FIG. 3, the connecting structure 11 comprises an end ring 20, a cradle ring 21 and a supporting ring 22. FIG. 3 further shows that the tank 10 is composed of a tank shell 23 and tank bottoms 24 welded thereto, the main portion 25 of each bottom being spherically curved with a relatively large radius, whereas the transition to the tank shell 23 is formed by a strongly arched rim zone 26. As illustrated in FIG. 3, the end ring 20 is joined by an external weld to the main portion 25 of the tank bottom 24 surrounded by the rim zone 26. The inside of the end ring is reinforced by a supporting ring 22 having its axially extending flange welded to the end ring 20 and having its radially inwardly facing flange welded to the tank bottom 24. The supporting ring 22 simultaneously has the function of sealing the internal corner region between the end ring 20 and the tank bottom 24 and to thereby protect said region from corrosion.

Figure 2:
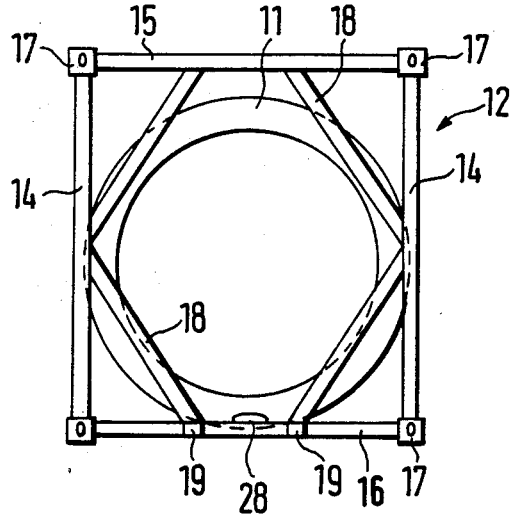
FIG. 2 is a view of the right-hand end of the container as seen in FIG. 1.

The axially extending portion of the cradle ring 21 is joined to the end ring 20, while the radially extending flange thereof is welded to the diagonal struts 18 and, as shown in FIG. 2, is in part welded also to the corner posts 14 of the end frame 12.

As shown in FIG. 2, the tank 10 is joined to the end frame 12 in inclined position with an inclination ratio of at least 1:20, so that a dome 27, which is provided at the upper left-hand end of the tank, is in the highest position and a drain 28 in the lower right-hand area of the tank is in the lowest position. In order to achieve this inclined position, the end ring at the right-hand end of the tank is eccentrically mounted with an upward offset relative to the tank bottom 24, as shown in FIG. 1, and the end ring at the left-hand end is eccentrically mounted with a downward offset relative to the tank bottom. Accordingly, the right-hand cradle ring 21 is mounted with a downward offset and the left-hand cradle ring 21 is mounted with an upward offset on the respective end frame 12. Given the spherical curvature of the tank bottom portions 25 and the circular shape of the end rings 20 and the cradle rings 21, any desired inclination angle may be selected within the tolerances determined by the external dimensions of the container, wherein the mounting of the tank 10 may be compared, as it were, with a ball and socket joint. The inclination angle is limited by the rule that the entire circumference of the end rings 20 must engage the spherically curved central portion 25 of the tank bottoms 24 in order to ensure a continuous tension-free connection.

For assembly, the end rings 20 are initially welded to the two tank bottoms 24 and the cradle rings 21 are welded to the two end frames 12 with the upward and, respectively, downward offset corresponding to the desired tank inclination, whereupon the end rings 20 are introduced into the cradle rings 21. The movability between end ring 20 and cradle ring 21, which exists until final permanent fixing has been effected, ensures compensation of length tolerances.

Figure 5:
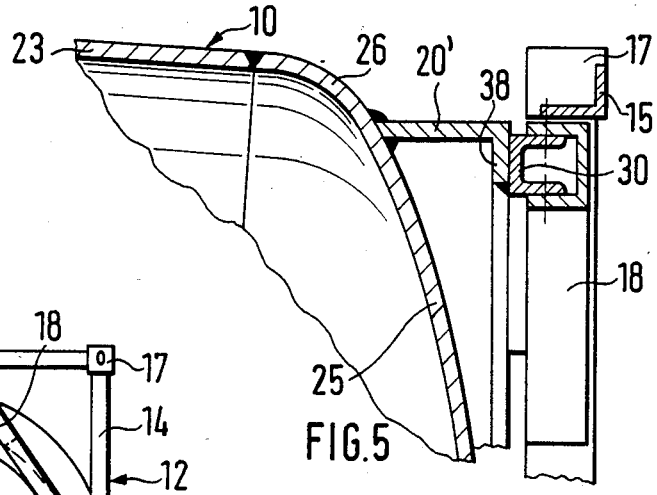
FIG. 5 is an enlarged sectional view similar to FIG. 3 through the upper right-hand corner of the embodiment shown in FIG. 4.

In the embodiment of the connecting structure shown in FIG. 5, the diagonal struts 18 are constituted by U-beams and welded to the corner posts and cross-pieces of the end frame 12 such that their open sides face the tank 10. The end ring 20' has an L-shaped cross-section, and its axially extending flange is welded to the spherically curved portion 25 of the tank bottom 24. The other flange 38 of the end ring 20' extends radially inwardly.

Figure 4:
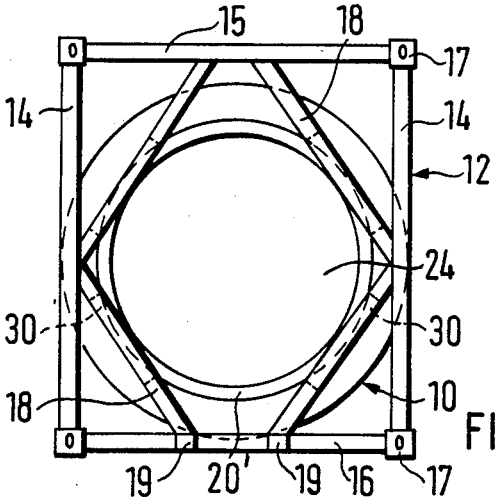
FIG. 4 is an end view similar to FIG. 2 of another embodiment.

To each of the diagonal struts 18 there is coupled an additional diagonal element 30 which—as shown in broken lines in FIG. 4—extends only along that part of the length of the diagonal strut 18 where the latter intersects the end ring in axial alignment therewith. These sectional elements 30 have a radially extending surface facing the tank and welded to the radial flange 38.

As shown in FIG. 5, the additional diagonal elements 30 have U-shaped cross-section facing outwardly from the tank 10 and engaging in the U-profile of the diagonal struts 18. It is also possible to dimension the two diagonal elements in such a way that the diagonal strut 18 engages in the profile of the diagonal element 30. As indicated by the dash-dot line in FIG. 5, the two members 18 and 30 are bolted to each other so that the end frame 12 may be detached from the tank 10 by removal of the threaded bolts.

Figure 6:
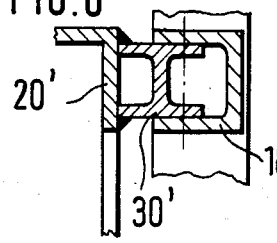
FIGS. 6 and 7 show different configurations of the diagonal struts and additional diagonal elements in views similar to that of FIG. 5.
Figure 7:
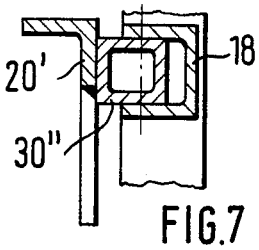

In the alternative embodiments shown in FIG. 6 and 7, the diagonal elements 30' and 30'' have H-shaped and box-shaped cross-section, respectively, and engage in a similar manner as shown in FIG. 5 in the U-profile of the diagonal struts 18 which is open towards the tank.

For assembly of the freight container according to the embodiments of FIGS. 4 to 7, the two end rings 20' are initially welded to the respective tank bottom portions 25 and the diagonal elements 30 are introduced into the diagonal struts 18 of the end frames 12. The three thus prepared members are then held in their prescribed mutual relationship, and the diagonal elements 30 are moved axially until their radial surfaces meet the radial flanges 38 of the end rings 20'. In this position the radial flanges 38 are tacked to the diagonal elements 30. Finally, the diagonal elements 30 are either bolted or welded to the diagonal struts 18. Alternatively, two of the three prepared elements may inititally be joined permanently, and thereupon the remaining free end group may be displaced with due consideration of the desired final dimensions and may then be secured.

Figure 8:
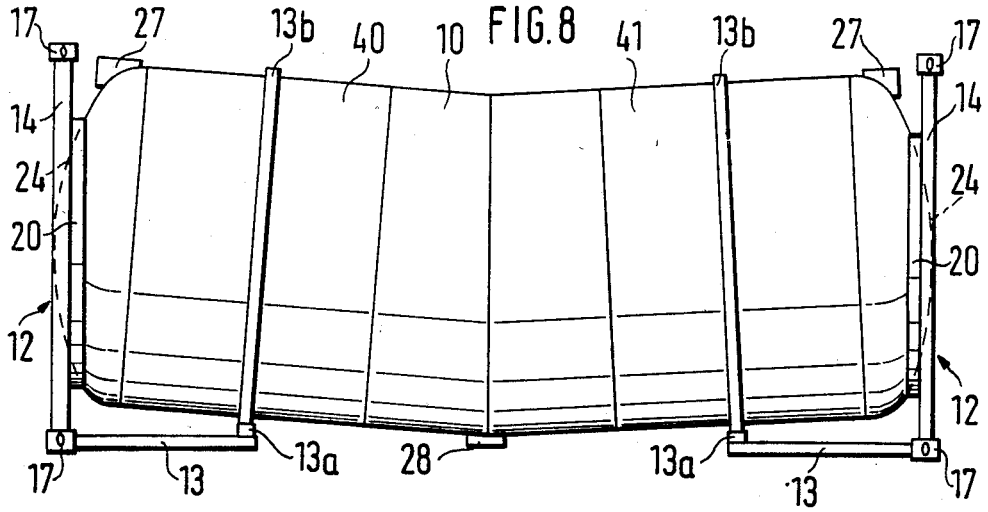
FIG. 8 is a side view of a freight container according to a further embodiment of the invention.

In the embodiment of FIG. 8, the tank is formed by two cylindrical shell portions 40, 41 of identical diameter, interconnected in the middle of the container to form a bent overall structure (sometimes referred to as "banana"). Each shell portion 40, 41 has an end bottom 24 which is joined through a connecting structure of any of the types shown in FIGS. 2 to 7 to the respective end frame 12. A dome 27 is provided at the highest portion of each tank half, and a common drain 28 at the lowermost central location of the tank.

An advantage of the tank structure shown in FIG. 8 over that of FIG. 1 resides in a reduction of the overall height of the container at given overall length, tank diameter and angle of inclination.

I claim:

1. A freight container comprising:

a supporting structure having a pair of mutually spaced, substantially aligned end frames and defining a first longitudinal axis, a tank disposed between said pair of end frames, and having a cylindrical shell portion defining a second longitudinal axis and spherically curved end bottom portions, and connecting means joining said tank to said pair of end frames, said connecting means including a pair of circular end rings, each eccentrically fixed to the respective end bottom portion for mounting said tank with an inclination between said first and second longitudinal axes, such that minimal stress mounting of said tank to the end frames at a desired inclination is facilitated.

2. The freight container of claim 1, wherein said tank and said end frame form together a self supporting structure whereby said tank body itself accommodates longitudinal forces of said container.

3. The freight container of claim 2, further comprising:

diagonal members having their outer ends connected to respective corners of said end frames and their inner ends joined to the tank for providing additional support to said inclined tank; and transitional connecting means interposed between said tank and said diagonal members for connecting the same, said connecting means varying in height for facilitating said connection.

4. The freight container of claim 3, further comprising:

reinforcing rings extending circumferentially about the exterior of said tank and interposed between said transitional connecting means and said tank.

5. The freight container of claim 1, wherein said tank includes a first cylindrical shell portion defining said second longitudinal axis and a second cylindrical shell portion defining a third longitudinal axis, said first and second shell portions being interconnected to form an integral tank shell with said second and third axis intersecting each other at an angle, and wherein said tank is joined to said pair of end frames so that said second and third axes intersect at a point located below said first axis.

6. The freight container of claim 1, wherein said connecting means further includes a cradle ring of L-shaped cross-section with an axially extending flange joined to the end ring and an outwardly facing radial flange joined to the respective end frame.

7. The freight container of claim 6, wherein each end frame includes vertical corner posts , horizontal cross-pieces, and diagonal struts each extending between a corner post and a cross-piece, said cradle ring being secured to said corner posts and diagonal struts.

8. The freight container of claim 1, wherein each end frame includes vertical corner posts, horizontal cross-pieces, and diagonal struts each extending between a corner post and a cross-piece, wherein said end ring has an L-shaped cross-section with an axially extending flange welded to the respective end bottom portion and a radially extending flange, and wherein an additional diagonal element is secured to each diagonal strut, each diagonal element having at least one first surface extending in parallel to an axially extending surface of the associated diagonal strut and a second surface extending in parallel to the radially extending flange of the end ring and being coupled thereto.

9. The freight container of claim 8, wherein said additional diagonal elements encompass said diagonal struts.

10. The freight container of claim 8, wherein said additional diagonal elements extend only along that part of the length of said diagonal struts where they intersect the end ring.

11. The freight container of claim 8, wherein said diagonal struts have U-shaped cross-section opening towards the tank.

12. The freight container of claim 11, wherein said additional diagoanal elements have substantially parallel legs in cross-section joined by at least one other leg transverse thereto.

13. The freight container of claim 12, wherein said additional diagonal elements engage in the U-shaped cross-section of said diagonal struts.

14. The freight container of claim 8, wherein said additional diagonal elements have H-shaped cross-section.

15. The freight container of claim 8, wherein said additional diagonal elements have box-shaped cross-section.

* * * * *